US005210878A

United States Patent [19]

Triche

[11] Patent Number: 5,210,878

[45] Date of Patent: May 18, 1993

[54] WELDER'S PROTECTIVE ARTICLES

[76] Inventor: Freddie J. Triche, 1537 Bernice St., Morgan City, La. 70380

[21] Appl. No.: 851,484

[22] Filed: Mar. 13, 1992

[51] Int. Cl.[5] ..... A41D 13/00

[52] U.S. Cl. ..... 2/16; 2/51; 2/94; 2/125

[58] Field of Search ..... 2/16, 59, 2, 51, 88, 2/94, 108, 125, 126, 92, 93, 115, 247

[56] References Cited

U.S. PATENT DOCUMENTS

| | | | |
|---|---|---|---|
| D. 282,409 | 2/1986 | Dryzal | D2/361 |
| 1,284,536 | 11/1918 | Yaeger . | |
| 1,851,011 | 3/1932 | Jensen . | |
| 2,063,469 | 12/1936 | Smith | 2/94 |
| 2,320,783 | 6/1943 | Lee | 2/94 |
| 2,388,234 | 11/1945 | Abel | 2/51 |
| 2,394,136 | 2/1946 | Bakke | 2/161 |
| 2,446,654 | 8/1948 | Krcmar | 2/24 |
| 2,465,286 | 3/1949 | Silversteen | 2/2 |
| 3,374,487 | 3/1968 | Slimovitz | 2/161 |
| 3,889,297 | 6/1975 | Jarboe et al. | 2/16 |
| 3,991,420 | 11/1976 | Savarino | 2/16 |
| 4,011,596 | 3/1977 | Chang | 2/16 |
| 4,047,250 | 9/1977 | Norman | 2/161 A |
| 4,099,269 | 7/1978 | Porner | 2/16 |
| 4,120,052 | 10/1978 | Butler | 2/16 |
| 4,190,902 | 3/1980 | Rhee | 2/16 |
| 4,344,189 | 8/1982 | Futere et al. | 2/16 |
| 4,366,813 | 1/1983 | Nelson | 128/800 |
| 4,445,232 | 5/1984 | Nelson | 2/161 R |
| 4,757,555 | 7/1988 | Gold | 2/16 |
| 4,884,297 | 12/1989 | Triche | 2/16 |
| 4,922,292 | 5/1990 | DeJournett | 2/16 |
| 5,014,345 | 5/1991 | Dumont | 2/2 |
| 5,023,953 | 6/1991 | Bettcher | 2/126 |
| 5,052,052 | 10/1991 | Gilford et al. | 2/2 |
| 5,067,175 | 11/1991 | Gold | 2/16 |
| 5,101,511 | 4/1992 | Elverskog | 2/108 |

FOREIGN PATENT DOCUMENTS

| | | | |
|---|---|---|---|
| 158215 | 10/1985 | European Pat. Off. . | |
| 2600900 | 1/1988 | France . | |
| 136483 | 6/1919 | United Kingdom | 2/16 |

*Primary Examiner*—Clifford D. Crowder
*Assistant Examiner*—Amy Brooke Vanatta
*Attorney, Agent, or Firm*—Richard C. Litman

[57] ABSTRACT

A sleeve for the protection of the upper and lower arm of a person engaged in welding or the like includes a forearm pad providing insulation and additional comfort for the support arm of the welder. A person using the sleeve of the present invention may comfortably rest his support arm upon the material being welded without discomfort or burns from the heat absorbed due to the welding of the material, due to the forearm pad. Additionally, the sleeve may be clipped to the collar or other clothing in order to prevent slippage down the arm of the welder. The insulating material contained within the pocket of the pad is replaceable in the event of wear and tear, and the pad has a strap overlay for further securing the sleeve to the arm of the wearer. A further embodiment provides a cape for the protection of the upper chest and back of the wearer, in combination with sleeves essentially including the various features of the sleeve of the first embodiment. The protection provided by such a cape is particularly valuable when engaged in overhead welding operations. The cape further provides for the attachment of a welder's apron, if desired, for even greater protection.

7 Claims, 2 Drawing Sheets

WELDER'S PROTECTIVE ARTICLES

FIELD OF THE INVENTION

This invention relates generally to protectors, guards and the like, and more specifically to embodiments of an article to protect a person's forearms and/or upper body when welding.

BACKGROUND OF THE INVENTION

Hazards due to burns from spattered molten metal, sparks, etc. are well known in the welding trade, particularly that part of the trade relating to industrial pipe welding and the welding of relatively heavy structural metals. Relatively heavy gauge metals, as well as sufficiently large masses of lighter gauges, require relatively large amounts of heat input for welding, as the mass of metal provides a relatively large heat sink to absorb the heat generated by welding torch or electrode arc.

When performing such welding, a standard practice is for the welder to rest his support arm (the arm not actually holding the welding torch or electrode) upon the surface of the metal structure being welded. As this structure tends to absorb a great deal of heat from the welding, it is oftentimes uncomfortable at best to use such a structure which is being welded as a rest for the support arm. While various protective articles have been developed to protect the welder, such as aprons and gloves, very few are known which serve to protect the forearm of a welder from heat and burns, as well as protecting the remainder of the arm from spatters and sparks.

The need arises for a protective article providing protection for the forearm of a welder, in combination with other protective sleeves. The article should provide both padding for comfort and insulation for the protection of the forearm which may be in contact with a relatively hot metal structure.

DESCRIPTION OF THE RELATED ART

U.S. Pat. No. 2,394,136 issued to R. Bakke on Feb. 5, 1946 discloses a Welding Glove including an overlay of relatively inflexible material over the back of the hand and fingers of the glove. The device includes protection extending approximately to the limit of the conventional cuff of a welders glove; no protection is disclosed higher up the forearm.

U.S. Pat. No. 3,374,487 issued to M. L. Slimovitz on Mar. 26, 1968 discloses a Welder's Glove. The device does not protect the area of the arm above that protected by the conventional cuff of a welder's glove, nor is any insulation disclosed.

U.S. Pat. No. 4,099,269 issued to M. J. Porner on Jul. 11, 1978 discloses a Protective Device primarily directed to use with animals, particularly for the protection of the fetlocks of horses. As such, it is more closely related to such devices as shin guards and the like. The device includes layers of air pockets formed within the material. While this construction provides the insulation desired in the field of the present invention, it also provides greater rigidity than that desired in the present invention and fails to protect against burns from molten metal spatters due to the nature of the preferred material.

U.S. Pat. No. 4,190,902 issued to J. G. Rhee on Mar. 4, 1980 discloses a Protective Device For the Elbow, Arm, Palm And Hand. The device is contoured to conform to the general shape of the forearm and elbow, and means for securing the device to the forearm is provided. The device is directed to the protection of impact injuries rather than burns.

U.S. Pat. No. 4,445,232 issued to L. D. Nelson on May 1, 1984 discloses a Welders Glove providing primarily for a specific stretch orientation of the glove material. The insulation provided is of a relatively thin nature, due to the flexibility required in the area of the hand.

U.S. Pat. No. Des. 282,409 issued to D. D. Dryzal on Feb. 4, 1986 discloses a design for a Welder's Glove Protector. As this is a design patent, no function is disclosed. However, it does not appear that the device provides any protection above the lower portion of the forearm, nor is any insulation apparent.

U.S. Pat. No. 4,884,297 issued to applicant on Dec. 5, 1989 discloses an Arm Protector related to applicant's present invention disclosed herein. The device disclosed in applicant's prior issued patent does not lend itself to installation in combination with existing known protective sleeves.

In addition to the above, applicant is aware of the following patents provided in the course of the examination of his issued U.S. Pat. No. 4,884,297 discussed above: U.S. Pat. No. 1,284,536 issued to B. J. Yaeger on Nov. 12, 1918 for a Sleeve Protector; U.S. Pat. No. 1,851,011 issued to K. E. Jensen on Mar. 29, 1932 for an Arm Protector; U.S. Pat. No. 2,446,654 issued to J. A. Krcmar on Aug. 10, 1948 for a Protector Pad; U.S. Pat. No. 4,011,596 issued to E. G. Chang on Mar. 15, 1977 for a Forearm and Wrist Protector; U.S. Pat. No. 4,047,250 issued to B. Norman on Sep. 13, 1977 for a Contoured Wrist Support; U.S. Pat. No. 4,120,052 issued to C. D. Butler on Oct. 17, 1978 for a Cushioned Protector; U.S. Pat. No. 4,366,813 issued to R. E. Nelson on Jan. 4, 1983 for a Knee Brace; European Patent No. 158,215 to K. Tajima published on Oct. 16, 1985 for a Ski Pants Cover; and French Patent No. 2,600,900 to J. Roucou published on Jan. 8, 1988 for a Shin Pad. None of these patents are seen to relate to the present invention due to their nature as pads, protectors, and supports and the like in fields other than welding, and the resulting lack of protection against extreme heat provided by the present invention, as well as other differences.

None of the above noted patents, either singly or in combination, are seen to disclose the specific arrangement of concepts disclosed by the present invention.

SUMMARY OF THE INVENTION

By the present invention, an improved article for the protection of the arm of a welder is disclosed.

Accordingly, one of the objects of the present invention is to provide such an improved article in the form of a pad which may be installed within and used in combination with an existing welder's protective sleeve.

Yet another of the objects of the present invention is to provide means for securing a protective sleeve to another garment in order to securely hold the sleeve in place.

A further object of the present invention is to provide a pad for such a sleeve which provides insulating properties to further protect the arm of the wearer of the sleeve.

An additional object of the present invention is to provide a sleeve in which such a pad is easily removable and replaceable.

Another object of the present invention is to provide a sleeve which is constructed of heat and fire resistant materials.

Still another of the objects of the present invention is to provide a protective article protecting both arms and the upper torso of a welder and further incorporating insulating pads for both forearms.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
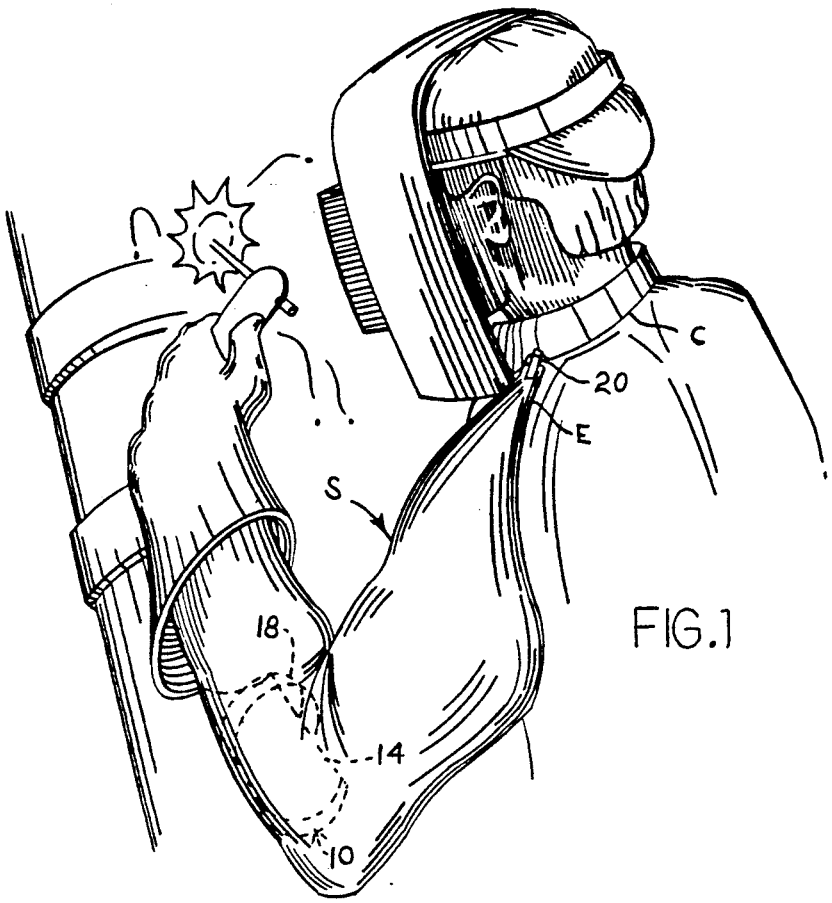
FIG. 1 is a perspective view of the protective pad of the present invention, in combination with a welder's protective sleeve.
Figure 2:
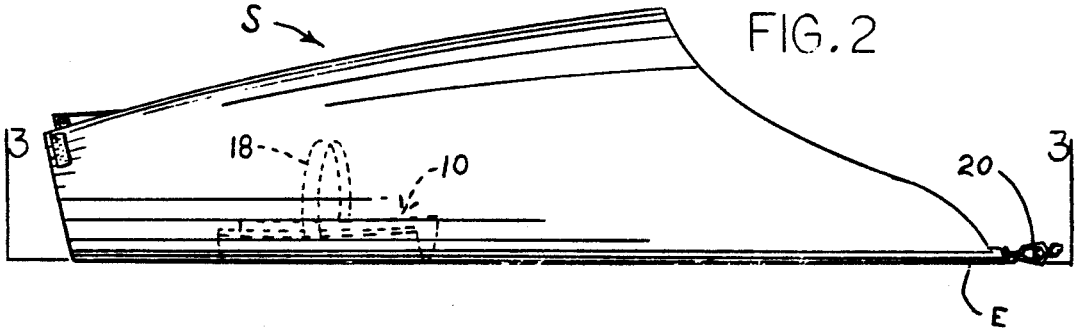
FIG. 2 is a side view of the sleeve of FIG. 1 showing the installation of the protective pad and retaining strap.
Figure 3:
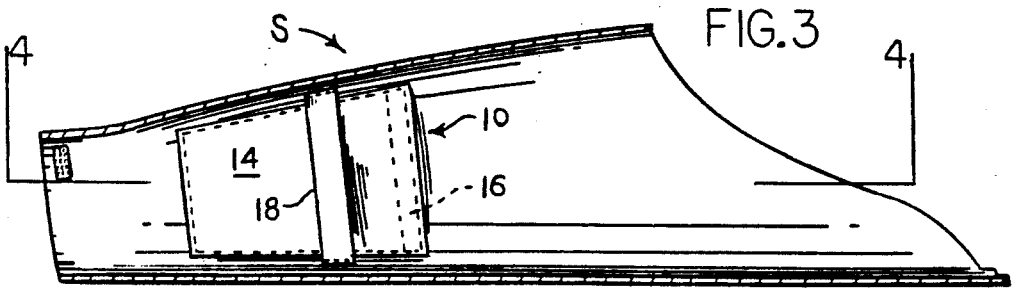
FIG. 3 is a view in section along line 3—3 of FIG. 2.

Referring now to the drawings, particularly FIG. 3 of the drawings, the present invention will be seen to relate to a protective pad 10 for use by a welder or the like for the protection of the welder's support arm from heat while engaged in such activities. As discussed in the Background of the Invention, the metals generally used in heavy industrial welding (ships, pipelines, building structures, etc.) are generally of a very heavy gauge, and a great deal of heat must be input by means of a welding torch or electric arc in order to make up for that heat lost to the surrounding metal mass due to its properties as a "heat sink." In performing such welding, it is common for a welder to steady or support his "torch hand" (generally the right hand, for a right handed welder), or perhaps the torch or electrode holder itself, with his opposite hand and arm (generally the left). The support arm is commonly rested upon the structure being welded, in order to provide for a steady and accurate flame (or electric arc) to precisely the desired location.

Due to the great amount of heat being absorbed by the surrounding metal structure, contact with that structure will at best be uncomfortable, and may well result in at least superficial burns to the portion of the welder's support arm in contact with the metal surface. Moreover, molten metal spatters and/or sparks often fly for several inches from the weld itself, and exposed skin will be susceptible to burns from such sparks and molten metal droplets. While protective sleeves and the like such as sleeve S are used in the trade, they fail to provide insulation or protection from the heat developed in such work.

Figure 4:
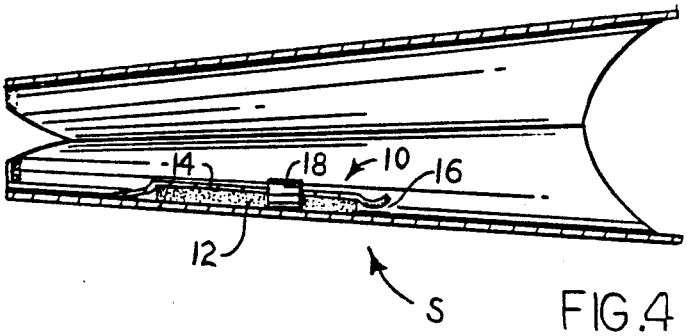
FIG. 4 is a view in section along line 4—4 of FIG. 3.
Figure 5:
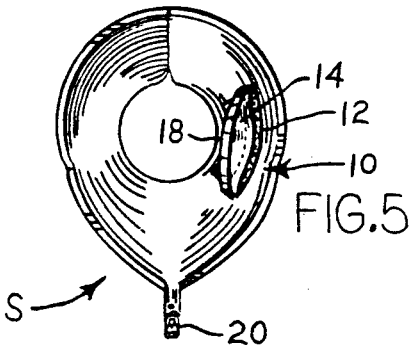
FIG. 5 is an end view of the interior of a protective sleeve, showing further views of the improvements of the present invention.

Pad 10 of the present invention responds to this need, by providing an additional thickness of insulating material 12 (shown more clearly in FIGS. 4 and 5) which may be installed within the forearm area of a sleeve S. Pad 10 comprises a sheet of insulating material 12, which is inserted within a pocket 14 within sleeve S.

Such sleeves S are generally formed of a heat and fire resistant material, such as leather. Leather has traditionally been used for welder's aprons, gloves and the like, and the pocket 14 of the present invention also makes use of leather in a preferred embodiment. However, it is possible that some other suitable material or materials, ether natural or synthetic, may be incorporated as desired.

Insulation sheet 12 is preferably formed of a resilient and flexible closed cell foam plastic material of sufficient thickness to provide both comfort for the wearer of sleeve S when resting his forearm upon a relatively hard surface, and further to provide sufficient insulating properties. Insulation 12 is contained within a suitably sized pocket 14 secured to the inner surface of the forearm of sleeve S. Preferably, pocket 14 is secured to the inner surface of sleeve S during construction for greater protection. Pocket 14, and thus any insulation 12 contained therein, is located within sleeve S at a position which places it beneath the forearm of the wearer of sleeve S when in use. Thus, insulation 12 will be properly positioned between the forearm of the wearer of sleeve S and any surface underlying the wearer's forearm. An examination of the drawing figures will show pocket 14, and thus insulation 12, to be positioned within sleeve S so as to lie between the forearm of the wearer of a sleeve S and a surface upon which the wearer might rest his forearm while working.

In the course of use of sleeve S, insulation 12 may deteriorate due to heat, compression from the overlying arm of the wearer of sleeve S, etc. Accordingly, it is desirable to provide access to the interior of pocket 14 for removal and replacement of insulation 12. The present invention provides for such access by pocket securing means 16. Pocket securing means 16 may comprise mating portions of hook and loop fastening material, as shown in the present invention, or alternatively other means such as snaps or other closure means. A non-metallic closure means as provided in the present invention is preferred, due to the potential conduction of heat through sleeve S by metallic closure means.

Additional security is provided for a sleeve S by means of a forearm strap 18, positioned within the forearm area of sleeve S across pocket 14. Strap 18 is preferably formed of an elastic material in order to provide a secure fit for various arm sizes and positions; other materials may be used as desired or required. The wearer may insert his hand between insulation 12 contained within pocket 14, and strap 18, thence continuing to draw sleeve S upward over the arm until the hand protrudes from the lower end of sleeve S.

At this point, sleeve S may be further secured to prevent slippage downward along the arm of the wearer by means of clip 20 attached to the upper end E of sleeve S. Clip 20 is located so as to overlie the wearer's shoulder. Thus, clip 20 may be secured to the collar C of the wearer, or alternatively to any other suitable attachment point.

A further embodiment comprises a cape 22 which is worn over the shoulders and includes a right sleeve 24 and left sleeve 26 extending therefrom. Sleeves 24 and 26 are formed essentially as a sleeve S discussed above, with the exception of the upper end extension and securing means. Sleeves 24 and 26 are also provided with protective pads 10 and retaining straps 18, including the other various features as installed in combination with sleeve S and described above.

In the case of cape 22, each sleeve 24 and 26 is joined to a central portion 28 which extends across the shoulders of the wearer and provides further protection for the shoulders, upper chest and upper back. Such protection is highly desirable, if not essential, in some situations, such as overhead welding.

Central portion 28 comprises a left front 30, right front 32, and back 34 which are assembled to form central portion 28. A collar 36 may be incorporated to provide even greater protection. Sleeves 24 and 26 are secured to central portion 28 by means of stitching 38 or other appropriate attachment means. Central portion 28 will be seen to extend downward from the shoulders sufficiently far to provide for the securing of sleeves 24 and 26; the bottom edge 40 need not extend downward further. Additional protection for the lower body, if desired, may be provided by additional means in combination with cape 22 as discussed further below.

Figure 6:
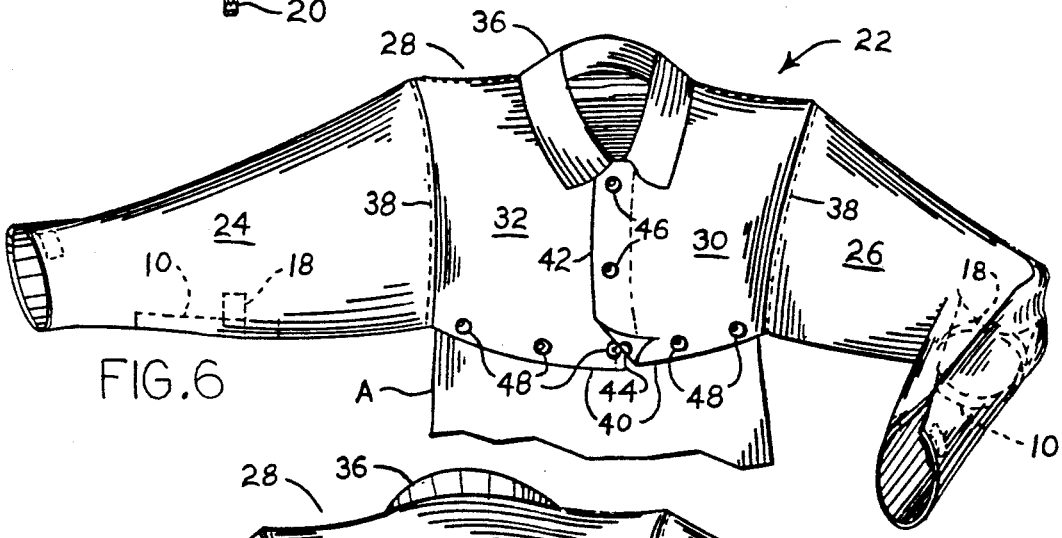
FIG. 6 is a front view of a second embodiment of the present invention, incorporating a left and a right sleeve in combination with a cape for further protection.
Figure 7:
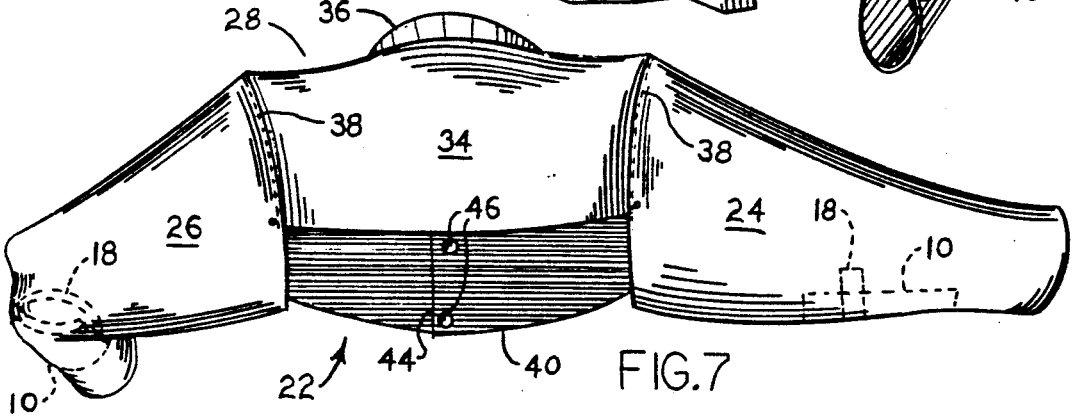
FIG. 7 is a rear view of the cape and double sleeve embodiment.

Left front 30 and right front 32 respectively each have a left front central edge 42 and right front central edge 44, which edges 42 and 44 include mating or complementary closure means 46, such as the snaps shown in FIG. 6 or other suitable means, providing for the overlapping closure of left and right front portions 30 and 32. Additional securing means 48 are provided along the lower edge 40 of left and right front portions 30 and 32, enabling cape 22 to be secured to the top of a welder's apron A. Thus, cape 22 may provide all of the protective benefits of sleeve S discussed above by means of sleeves 24 and 26, and further benefits by means of central portion 28 in combination with a welder's apron A, if desired. The protection thus provided is sufficiently complete to preclude burns to any likely area of the person wearing cape 22, while at the same time allowing ventilation due to the open back area below the lower edge 40 of cape 22. This ventilation is available at least in the back even when cape 22 is worn in combination with an apron A, and further ventilation is obviously provided when cape 22 is worn alone. While the protection provided by cape 22 may not be needed except in certain circumstances, a protective pad 10 in combination with a sleeve S will be seen to provide the protection generally needed by persons engaged in the welding, cutting or the like of heavy materials, and the greater protection required for persons engaged in overhead welding or similar operations is provided by means of cape 22 including sleeves 24 and 26 as discussed above.

It is to be understood that the present invention is not limited to the sole embodiment described above, but encompasses any and all embodiments within the scope of the following claims.

I claim:

1. An article for the protection of the upper body and upper and lower arms of a person engaged in welding and similar fields, said article comprising;

a cape including left and right front portions, a back portion, and a left and a right sleeve, said left sleeve joined to said left front portion and said back portion and said right sleeve joined to said right front portion and said back portion, each said sleeve having an interior including a pad disposed therein, with said pad having pocket means and said pocket means receiving an insulating material therein, a left and a right forearm securing strap disposed respectively within each said sleeve and transversely directly overlying each said pad, each said pad positioned adjacent the ulnar side of the lower arm of the person when each said sleeve is worn by the person, whereby each said sleeve provides protection from heat and other welding hazards for the upper and lower arm of the person wearing each said sleeve and further protection is provided by means of said left and right front portion and said back portion.

2. The cape of claim 1 wherein;

said left front, right front, and back portions include a collar.

3. The cape of claim 1 including;

means providing for the securing together of said left front portion to said right front portion of said cape.

4. The cape of claim 1 including;

means providing for the removable, temporary attachment of said cape to an apron.

5. The cape of claim 1 wherein;

each said pocket means includes closure means providing for the removal and replacement of each said insulating material.

6. The cape of claim 1 wherein;

said left front, right front, and back portions, each said sleeve, and said pocket means of each said pad are constructed of heat and fire resistant materials.

7. The cape of claim 6 wherein;

said fire resistant materials are leather.

* * * * *